US005246018A

United States Patent [19]

Deevi et al.

[11] Patent Number: 5,246,018

[45] Date of Patent: Sep. 21, 1993

[54] MANUFACTURING OF COMPOSITE HEAT SOURCES CONTAINING CARBON AND METAL SPECIES

[75] Inventors: Seetharama C. Deevi; Sarojini Deevi, both of Midlothian; Mohammad R. Hajaligol, Richmond; Harry V. Lanzillotti, Midlothian; Arnys C. Lilly, Jr., Chesterfield; D. Bruce Losee; Michael L. Watkins, both of Richmond, all of Va.

[73] Assignee: Philip Morris Incorporated, New York, N.Y.

[21] Appl. No.: 732,619

[22] Filed: Jul. 19, 1991

[51] Int. Cl.[5] ..... A24B 15/00

[52] U.S. Cl. ..... 131/359; 131/194; 44/520; 44/522

[58] Field of Search ..... 131/359, 337, 369, 194; 44/504, 520-522, 535

[56] References Cited

U.S. PATENT DOCUMENTS

| | | | |
|---|---|---|---|
| 1,771,366 | 7/1930 | Wyss et al. . | |
| 2,104,266 | 1/1938 | McCormick | 131/12 |
| 2,780,537 | 2/1957 | Stelling et al. | 75/26 |
| 2,907,686 | 10/1959 | Siegel | 131/2 |
| 3,200,819 | 8/1965 | Gilbert | 128/208 |
| 3,258,015 | 6/1966 | Ellis et al. | 131/171 |
| 3,356,094 | 12/1967 | Ellis et al. | 131/266 |
| 3,572,993 | 3/1971 | Rogers | 23/208 |
| 3,812,864 | 5/1974 | Cartwright | 131/359 |
| 3,885,023 | 5/1975 | Gray et al. | 423/439 |
| 3,943,941 | 3/1976 | Boyd et al. | 131/2 |
| 4,141,369 | 2/1979 | Burruss | 131/171 |
| 4,195,645 | 4/1980 | Bradley, Jr. et al. | 131/337 |
| 4,252,687 | 2/1981 | Dale et al. | 252/455 |
| 4,256,609 | 3/1981 | Dale et al. | 252/455 |
| 4,303,083 | 12/1981 | Burruss, Jr. | 131/271 |
| 4,310,334 | 1/1982 | Waldron | 48/197 |
| 4,317,460 | 3/1982 | Dale et al. | 131/334 |
| 4,340,072 | 7/1982 | Bolt et al. | 131/273 |
| 4,708,151 | 11/1987 | Shelar | 131/359 |
| 4,714,082 | 12/1987 | Banerjee et al. | 131/359 |
| 4,789,534 | 12/1988 | Laine | 423/241 |
| 4,793,365 | 12/1988 | Sensabaugh, Jr. et al. | 131/194 |
| 4,799,979 | 1/1989 | Baldi | 149/5 |
| 4,842,759 | 6/1989 | Okamura et al. | 252/62.51 |
| 4,991,606 | 2/1991 | Serrano et al. | 131/359 |
| 5,040,552 | 8/1991 | Schleich et al. | 131/359 |
| 5,146,934 | 9/1992 | Deevi et al. | 131/359 |

FOREIGN PATENT DOCUMENTS

| | | |
|---|---|---|
| 0117355 | 12/1983 | European Pat. Off. . |
| 0123318 | 4/1984 | European Pat. Off. . |
| 0180162 | 10/1985 | European Pat. Off. . |
| 0222542 | 10/1986 | European Pat. Off. . |
| 0223439 | 10/1986 | European Pat. Off. . |
| 0236992 | 3/1987 | European Pat. Off. . |
| 0245732 | 5/1987 | European Pat. Off. . |
| WO90/10394 | 3/1989 | World Int. Prop. O. . |

OTHER PUBLICATIONS

Chapter 6 "Removal of Carbon Monoxide", pp. 97-117, *Catalyst Handbook,* Springer-Verlag New York Inc. Wolfe Scientific Books/London-England (1970).

(List continued on next page.)

*Primary Examiner*—V. Millin
*Assistant Examiner*—J. Doyle
*Attorney, Agent, or Firm*—Joseph M. Guiliano; Marta E. Gross

[57] ABSTRACT

This invention relates to improved methods for making a composite heat source comprising carbon and metal species. The composite heat source made by the methods of this invention have ignition temperatures that are substantially lower than carbonaceous heat sources, while at the same time provide sufficient heat to release a flavored aerosol from a flavor bed for inhalation by the smoker. Upon combustion, the heat source produces substantially no carbon monoxide. The metal species may be prepared by mixing a metal oxide, metal and a carbon source, pre-forming the metal oxide/metal/carbon source mixture into a shape and converting the mixture to metal species in situ, without substantially altering the original shape of the mixture.

16 Claims, 3 Drawing Sheets

OTHER PUBLICATIONS

R. A. Dictor and A. T. Bell, "Fischer-Tropsch Synthesis over Reduced and Unreduced Iron Oxide Catalysts", *Journal of Catalysts,* 97, pp. 121-136 (1986).

Imamura et al., "Oxidation of Carbon Monoxide Catalyzed by Manganese-Silver Composite Oxides", *Journal of Catalysts,* 109, pp. 198-205 (1988).

Kojima et al., "Catalysis by Transition Metal Carbides", *Journal of Catalysts,* 73, pp. 128-135 (1982).

M. H. Litt and S. M. Aharoni, "Iron Carbides: Preparation from Carbon-Rich Matrix", *Ind. Eng. Chem. Prod. Res. Develop.,* 10, pp. 176-178 (1971).

J. W. Reynolds, "Results of Experimental Work to Remove CO from a Mixture of $O_2$ and $N_2$ by Use of Modified Cigarette Filters", Publication from Research Laboratories/Tennessee Eastman Company.

A. Sacco, Jr. and R. C. Reid, "Limitations in Water--Production in the Iron Catalyzed Bosch Process", ASME Paper No. 78-ENAs-4, Mar. 1978.

MANUFACTURING OF COMPOSITE HEAT SOURCES CONTAINING CARBON AND METAL SPECIES

BACKGROUND OF THE INVENTION

This invention relates to improved methods for making composite heat sources. The heat sources made by the methods of this invention are particularly suitable for use in a smoking article such as that described in Commonly assigned U.S. Pat. No. 4,991,606. The composite heat sources have low ignition and high combustion temperatures that generate sufficient heat to release a flavored aerosol from a flavor bed for inhalation by the smoker. Upon combustion, the composite heat sources produce virtually no carbon monoxide.

According to the methods of this invention, a metal oxide, a fully reduced metal or combination of these is mixed with a carbon source. Upon heating, the mixture is, in part, converted to metal species. As used herein, metal species is meant to include metal carbides, metal oxides and/or the fully or partially reduced metal which arises during preparation of the composite heat source. In a preferred embodiment, the metal oxide/carbon source mixture is pre-formed into a desired shape and converted to metal species in situ, without substantially altering the shape of the mixture.

There have been previous attempts to provide a heat source for a smoking article. While providing a heat source, these attempts have not produced a heat source having all of the advantages of the present invention.

For example, Siegel U.S. Pat. No. 2,907,686 discloses a charcoal rod coated with a concentrated sugar solution which forms an impervious layer during burning. It was thought that this layer would contain gases formed during smoking and concentrate the heat thus formed.

Ellis et al. U.S. Pat. No. 3,258,015 and Ellis et al. U.S. Pat. No. 3,356,094 disclose a smoking device comprising a nicotine source and a tobacco heat source.

Boyd et al. U.S. Pat. No. 3,943,941 discloses a tobacco substitute which consists of fuel and at least one volatile substance impregnating the fuel. The fuel consists essentially of combustible, flexible and self-coherent fibers made of a carbonaceous materials containing at least 80% carbon by weight. The carbon is the product of the controlled pyrolysis of a cellulose-based fiber containing only carbon, hydrogen and oxygen.

Bolt et al. U.S. Pat. No. 4,340,072 discloses an annular fuel rod extruded or molded from tobacco, a tobacco substitute, a mixture of tobacco substitute and carbon, other combustible materials such as wood pulp, straw and heat-treated cellulose or a sodium carboxymethylcellulose (SCMC) and carbon mixture.

Shelar et al. U.S. Pat. No. 4,708,151 discloses a pipe with replaceable cartridge having a carbonaceous fuel source. The fuel source comprises at least 60–70% carbon, and most preferably 80% or more carbon, and is made by pyrolysis or carbonization of cellulosic materials such as wood, cotton, rayon, tobacco, coconut, paper and the like.

Banerjee et al. U.S. Pat. No. 4,714,082 discloses a combustible fuel element having a density greater than 0.5 g/cc. The fuel element consists of comminuted or reconstituted tobacco and/or a tobacco substitute, and preferably contains 20–40% by weight of carbon.

Published European patent application 0 117 355 by Hearn et al. discloses a carbon heat source formed from pyrolized tobacco or other carbonaceous material such as peanut shells, coffee bean shells, paper, cardboard, bamboo, or oak leaves.

Published European patent application 0 236 992 by Farrier et al. discloses a carbon fuel element and process for producing the carbon fuel element. The carbon fuel element contains carbon powder, a binder and other additional ingredients, and consists of between 60% and 70% by weight of carbon.

Published European patent application 0 245 732 by White et al. discloses a dual burn rate carbonaceous fuel element which utilizes a fast burning segment and a slow burning segment containing carbon materials of varying density.

These heat sources are deficient because they provide unsatisfactory heat transfer to the flavor bed, resulting in an unsatisfactory smoking article, i.e., one which fails to simulate the flavor, feel and number of puffs of a conventional cigarette. Commonly assigned U.S. Pat. No. 5,076,296, solved this problem by providing a carbonaceous heat source formed from charcoal that maximizes heat transfer to the flavor bed, releasing a flavored aerosol from the flavor bed for inhalation by the smoker, while minimizing the amount of carbon monoxide produced.

However, all conventional carbonaceous heat sources liberate some amount of carbon monoxide gas upon ignition. Moreover, the carbon contained in these heat sources has a relatively high ignition temperature, making ignition of conventional carbonaceous heat sources difficult under normal lighting conditions for a conventional cigarette.

Attempts have been made to produce non-combustible heat sources for smoking articles in which heat is generated electrically, e.g., Burruss, Jr., U.S. Pat. No. 4,303,083, Burress U.S. Pat. No. 4,141,369, Gilbert U.S. Pat. No. 3,200,819, McCormick U.S. Pat. No. 2,104,266 and Wyss et al. U.S. Pat. No. 1,771,366. These devices are impractical and none has met with any commercial success.

Attempts have been made to produce a combustible, non-carbonaceous heat source. Commonly assigned U.S. Pat. No. 5,040,522, relates to such a heat source. Although combustion of the non-carbonaceous heat source yields up to tenfold less carbon monoxide than combustion of conventional carbonaceous heat sources, some carbon monoxide is still produced. Moreover, the method of producing the heat source disclosed in that application requires separate steps to produce the metal carbide and to form it into suitable shape for use as a heat source. Co-pending U.S. patent application Ser. No. 07/443,636, filed on Nov. 29, 1989, and commonly assigned herewith, relates to a metal nitride heat source that also produces substantially no carbon monoxide or nitrogen oxides upon combustion. Co-pending U.S. patent application Ser. No. 07/556,732, filed on Jul. 20, 1990 and commonly assigned herewith, is directed towards a heat source comprising carbon and metal carbide that also produces substantially no carbon monoxide upon combustion. Attempts have been made to produce pyrophoric materials comprising metal aluminides for use as a decoy for heat-seeking missiles, e.g., Baldi, U.S. Pat. No. 4,799,979. These devices, however, combust too rapidly and produce too intense a heat to be used as a heat source in a smoking article.

There have been previous attempts to prepare iron carbide. Grey et al. U.S. Pat. No. 3,885,023 and Okamura et al. published European patent application 0

180 162 disclose the preparation of iron carbide particles by reducing iron oxide in a carbon monoxide atmosphere. Stelling et al. U.S. Pat. No. 2,780,537, Okamura U.S. Pat. No. 4,842,759 and Shibuya et al. published European patent application 0 123 318 disclose the preparation of iron carbide particles by reducing iron oxide in a carbon monoxide/reducing gas mixture. Rogers U.S. Pat. No. 3,572,993 discloses the preparation of ultrafine iron carbide particles by reducing iron carbonyl in a carbon monoxide/hydrogen atmosphere.

Additionally, metal carbides may be prepared by reduction of the metal oxide with elemental carbon; carbidization of the metal or metal oxide with a gaseous species such as methane, ethane, ethylene or propane; and direct reaction of the fully reduced metal with elemental carbon. (Darken, L. S. and Gurry, R. W., *Physical Chemistry Of Metals*, McGraw Hill, New York (1953); Storms, K., *The Refractory Carbides*, Academic Press, New York (1967)).

Most known methods of preparing iron carbide generally require an atmosphere that reduces and carbidizes the precursor to the metal carbide. These gases are highly explosive and/or toxic and safety precautions must be taken when using them. Other shortcomings of known methods are their high capital and production costs. The gaseous reagents employed require expensive manifolds for the control of reaction conditions and the disposal or recovery of reagents. Moreover, when these methods are used, control of end-product composition is difficult. The use of a reducing/carbidizing atmosphere in these methods may result in polymorphous metal carbide containing carbon deposits, which may upon combustion, incompletely oxidize resulting in the generation of carbon monoxide, albeit at lower levels than in carbonaceous heat sources.

Finally, the metal carbide produced by these prior methods is in particulate form and must be formed into a shape suitable for use as a heat source. Metal carbides are by nature brittle, intractable materials, which, once formed, are difficult and expensive to form into a desired shape.

It would be desirable to provide a method for producing a composite heat source that does not require the use of dangerous gaseous reagents.

It would further be desirable to provide a method of producing a composite heat source at low capital and production costs.

It would be desirable to provide a method for producing a composite heat source which allows for control of end-product composition.

It would also be desirable to provide a composite heat source which is stable at ambient temperatures and humidity.

It would further be desirable to provide a method of producing a composite heat source in which the starting materials are pre-formed into a desired shape and converted in situ to a heat source containing carbon and metal species.

It would be desirable to provide a composite heat source that liberates virtually no carbon monoxide upon combustion even though the heat source contains a significant amount of carbon.

It would also be desirable to provide a composite heat source that has a low ignition temperature to allow for easy lighting under conditions typical for a conventional cigarette, while at the same time having a combustion temperature high enough to provide sufficient heat to release flavors from a flavor bed.

It would further be desirable to provide a composite heat source that does not self-extinguish prematurely.

SUMMARY OF THE INVENTION

It is an object of this invention to provide a method for producing a composite heat source containing carbon and metal species that does not require the use of dangerous gaseous reagents.

It is an object of this invention to provide a method of producing a composite heat source containing carbon and metal species at low capital and production costs.

It is an object of this invention to provide a method for producing a composite heat source starting with carbon, metal oxides and metals which allows for control of end-product composition.

It is yet another object of this invention to provide a composite heat source which is stable at ambient conditions and high humidity.

It is also an object of this invention to provide a method of producing a composite heat source starting with carbon, metal oxides and metals in which the starting materials are pre-formed into a desired shape and converted in situ to a composite heat source containing metal species.

It is an object of this invention to provide a composite heat source that liberates virtually no carbon monoxide upon combustion.

It is also an object of this invention to provide a composite heat source that has a low ignition temperature to allow for easy lighting under conditions typical for a conventional cigarette, while at the same time having a combustion temperature high enough to provide sufficient heat to release flavors from a flavor bed.

It is yet another object of this invention to provide a composite heat source that does not self-extinguish prematurely.

In accordance with this invention, there is provided an improved method for making a composite heat source which is particularly useful in a smoking article. The starting materials for composite heat sources made by the method of this invention comprise substantially a carbon material and a metal oxide and/or a fully reduced metal. Preferably, the heat source comprises substantially carbon and iron oxide (FeO), with smaller amounts of iron (Fe), and a low valency metal oxide such as $Fe_3O_4$. The low valency metal oxide helps to convert carbon monoxide to carbon dioxide. Catalysts and burn additives may be added to promote complete combustion and to provide other desired burn characteristics.

Upon combustion, the composite heat sources liberate substantially no carbon monoxide. The metal species has an ignition temperature similar to or substantially lower than that of conventional carbonaceous heat sources and is, therefore, easier to light. Once ignited, the carbon component of the heat source yields additional heat upon combustion, thereby preventing premature self-extinguishment. Combustion of the metal species produces metal oxides and carbon dioxide ($CO_2$), without formation of any significant amount of carbon monoxide (CO). The metal oxides present in the composite heat source act as oxidation catalysts to promote the conversion of CO to $CO_2$.

While the heat sources made by the methods of this invention are particularly useful in smoking devices, it is to be understood that they are also useful as heat sources for other applications, where having the characteristics described herein are desired.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
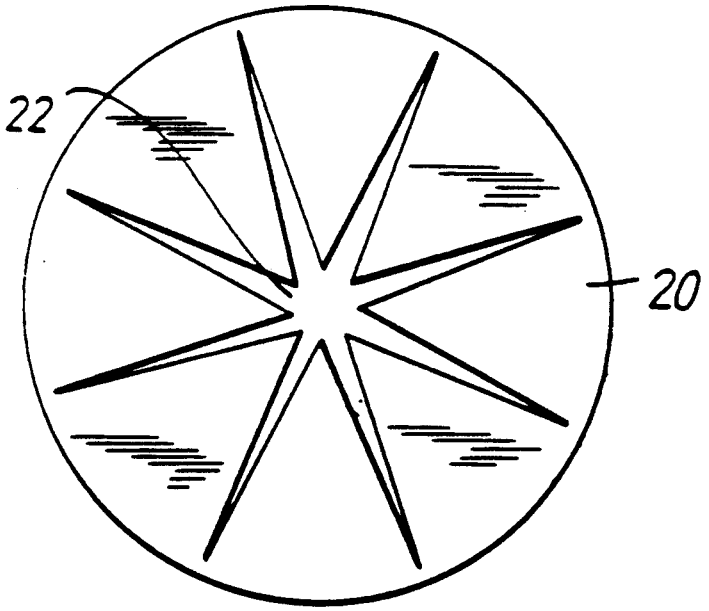
FIG. 1 depicts an end view of one embodiment of the composite heat source of this invention.
Figure 2:
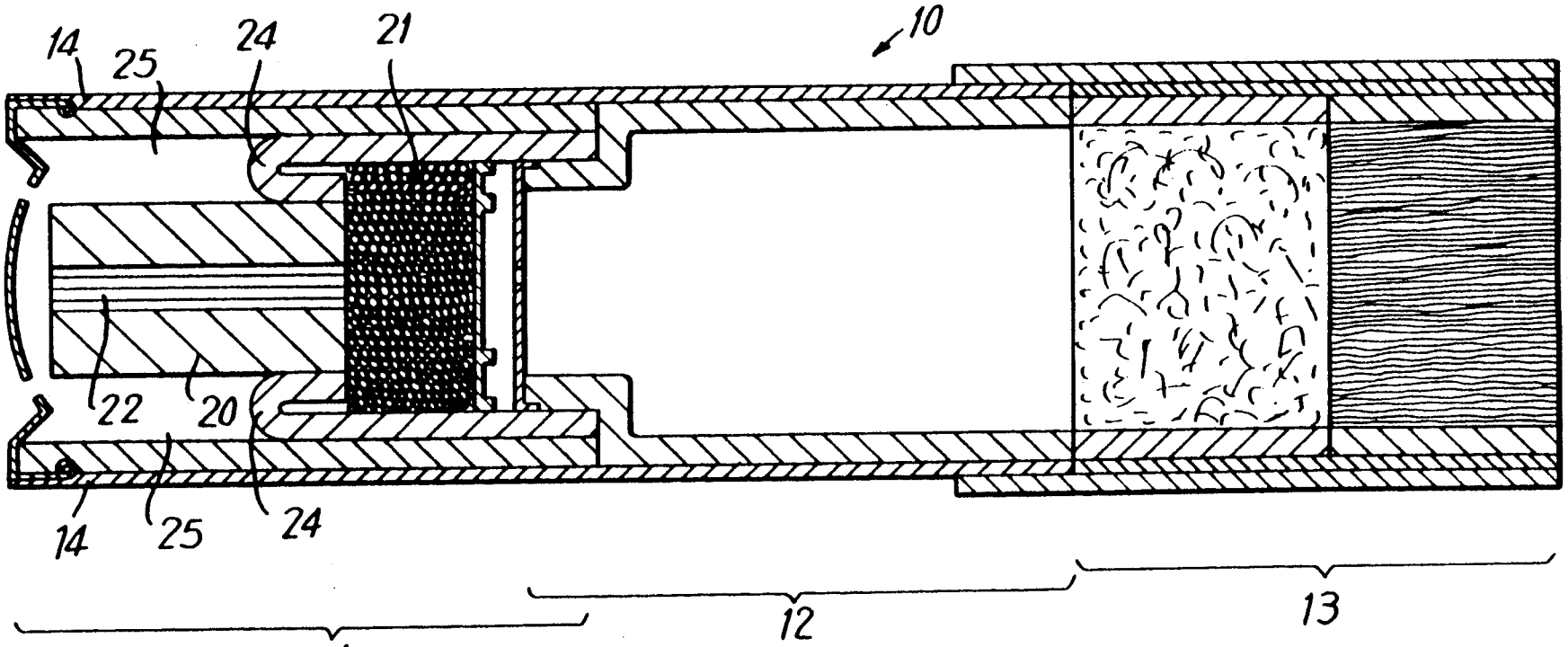
FIG. 2 depicts a longitudinal cross-sectional view of a smoking article in which the composite heat source of this invention may be used.

For use in a smoking article, the composite heat source should meet a number of requirements in order for the smoking article to perform satisfactorily. It should be small enough to fit inside the smoking article and still burn hot enough to ensure that the gases flowing through are heated sufficiently to release enough flavor from the flavor bed to provide flavor to the smoker.

The composite heat source should also be capable of burning with a limited amount of air until the metal species combusting in the heat source are expended. Upon combustion, the composite heat source should produce substantially no carbon monoxide. Combustion, the interaction of the composite heat source with oxygen during puffing to produce heat and light, is flameless and glowing.

The composite heat source should have a surface area preferably in the range from about 0.25 $m^2/g$ to about 250 $m^2/g$, more preferably 10 $m^2/g$ to about 150 $m^2/g$. Additionally, the composite heat sources made by this invention contain macropores (pores of between about 1 micron and about 5 microns in size), mesopores (pores of between about 20 Å and about 500 Å in size) and micropores (pores of up to about 20 Å in size). The average pore radius for the composite heat source should be between about 10Å and about 300Å.

The composite heat source should have an appropriate thermal conductivity. If too much heat is conducted away from the burning zone to other parts of the composite heat source, combustion at that point will cease when the temperature drops below the extinguishment temperature of the composite heat source, resulting in a smoking article which is difficult to light and which, after lighting, is subject to premature self-extinguishment. Such extinguishment is also prevented by having a composite heat source that undergoes essentially 100% combustion. The thermal conductivity should be at a level that allows the composite heat source upon combustion, to transfer heat to the air flowing through it while minimizing heat transfer to the mounting structure of the smoking article. Oxygen coming into contact with the burning composite heat source will almost completely oxidize the composite heat source. A mounting structure should retard oxygen from reaching the rear portion of the composite heat source thereby helping to extinguish the composite heat source after the flavor bed has been consumed. This also prevents the composite heat source from falling out of the end of the smoking article.

Heat sources comprising metal species are substantially easier to light than conventional carbonaceous heat sources and less likely to self-extinguish, but at the same time can be made to smolder at lower temperatures, thereby minimizing the risk of fire.

According to the methods of the present invention, a composite heat source containing carbon and metal species is produced by the steps of:

1) mixing metal oxides and/or fully reduced metals and a carbon source; and
2) heating the mixture and creating a reducing environment which allows the formation of a composite heat source containing carbon and metal species.

The metal oxide may be any metal-containing molecule capable of being converted to low valency metal oxide, metal carbide or metal. These include: derivatives of aluminum, titanium, tungsten, manganese, or niobium. Preferably, the metal oxide is iron oxide, metallic iron, or a mixture thereof. More preferably, the metal oxide is iron oxyhydroxide, $Fe_3O_4$ or FeO, and, most preferably, $Fe_2O_3$ (ferric oxide). Different phases of the various metal oxides and/or fully reduced metals may be used without substantially affecting the method of the invention or the course of the reduction reactions to composite heat source containing carbon and metal species. Either naturally-occurring or synthetic metal oxides and/or fully reduced metals may be used.

The carbon source is added to the metal oxides and metals in the form of substantially pure carbon, although materials which may be subsequently converted to carbon may also be used. Preferably, the carbon source is colloidal graphite, and, more preferably, activated carbon or activated charcoal.

In combining the metal oxides and metals with carbon, a sufficient amount of carbon should be added to the metal oxides and metals so that some carbon, between about 5% and about 70%, remains in the composition following the heating step. Preferably, between about 5% and about 45% and, more preferably, between about 20% and about 45% by weight of carbon is added to form the metal oxides/metals/carbon mixture.

The metal oxides, metals and carbon should be in particulate form. Preferably, the particle size of the metal oxides, metals and carbon range up to about 300 microns. More preferably, the particle size of the metal oxides and metals should range in size between about submicron and about 20 microns, while the particle size of the carbon should range in size between about submicron and about 40 microns. The particles may be prepared at the desired size, or they may be prepared at a larger size and ground down to the desired size. Various types of ball mills or other grinders can be used to grind the carbon to the desired size. Preferably a jet mill is used.

The surface areas of the metal oxides, metals and carbon particles are critical. The greater the surface area, the greater the reactivity of the metal oxides, metals and carbon, resulting in a more efficient reduction/carbidization reaction. Preferably, the surface area of the metal oxide and metal particles ranges from between about 0.2 $m^2/g$ to about 300 $m^2/g$, and more preferably, between about 1 $m^2/g$ and about 150 $m^2/g$. Preferably, the activated carbon particles range in surface area between about 0.5 $m^2/g$ and about 2000 $m^2/g$, more preferably, between about 100 $m^2/g$ and about 600 $m^2/g$.

The metal oxides, metals and carbon may be combined in a solvent. Any solvent which increases the fluidity of the metal oxides/metals/carbon mixture and does not affect the chemical reactivities of the individual components may be used. Preferred solvents are polar solvents such as methanol, ethanol, and acetone and, most preferably, water.

The metal oxides, metals and carbon mixture may then be combined with a carbonaceous binder which confers greater mechanical strength to the metal oxides/metals/carbon mixture. During the reduction of the metal oxides/metals/carbon mixture to metal species, the binder decomposes into carbon, $CO_2$, CO and organic volatiles. The metal oxides/metals/carbon mixture is combined with the binder using any of a number of convenient methods known in the art.

Any number of binders can be used to bind the particles of the metal oxides/metals/carbon mixture. The binder material may be used in combination with other additives such as potassium citrate, sodium chloride, vermiculite, bentonite or calcium carbonate. Preferable binders are carbonaceous, and include gums, such as guar gum, cellulose derivatives, such as methylcellulose and carboxymethylcellulose, phenolic resins (catalyzed with either acid or base), hydroxypropyl cellulose, flour, starches, sugar, alginates, polyvinyl alcohols, vegetable oil, or mixtures thereof. An especially preferred carbonaceous binder material is a mixture of flour and sugar combined with corn oil, preferably in the ratio of about 200 parts flour, about 103 parts sugar, and about 26 parts corn oil. The metal oxides/metals/carbon mixture as described above is preferably combined with the flour/sugar/corn oil binder system along with a solvent so that the mixture has a consistency suitable for extrusion.

The metal oxides/metals/carbon mixture may then be pre-formed into a desired shape. Any method capable of pre-forming the mixture into a desired shape may be used. Preferred methods include slip casting, injection molding and die compaction, and, most preferably, extrusion. Extrusion technique provides a means for continuous production of the composite heat sources. Extrusion manufacturing of the heat sources can be accomplished at very high speeds with extremely good dimensional tolerances and reproductibility in the thermal and physical properties. It is thus possible to reduce the cost of the heat source by controlling the manufacturing process and increasing the manufacturing speed to very high levels.

Dry pressing and injection molding also can be used to manufacture heat sources with intricate designs at lower speeds. However, the filling of the dies with material in dry pressing and injection molding requires a finite time and thus reduces the speed at which heat sources can be manufactured.

For the preferred shape—elongated rods—the material can be extruded at very high speeds and then cut into the required lengths for baking. Extrusion of heat sources can be done at speeds of 25 to 45 cm per second, therefore many heat sources can be produced. In comparison, several presses and injection molding units would be required to do the same. Additionally, the mixture could be extruded using a master die block containing several dies for the extrusion of multiple elongated rods, thus increasing the output.

The method by which the composite heat source is manufactured will, in part, determine the amount of binder added to the metal oxides/metals/carbon mixture. Preferably, between about 2% and about 20% binder is added to the metal oxides/metals/carbon mixture, based upon the weight of the metal oxides and metals. More preferably, between about 3% and about 10% binder is added to the metal oxides/metals/carbon mixture.

The metal oxides/metals/carbon mixture may be formed into any desired shape. Those skilled in the art will understand that a particular application may require a particular shape.

For use in a smoking article, the mixture is preferably formed into an elongated rod. Preferably, the rod is about 30 cm in length. The diameter for the composite heat source may range from about 3.0 mm to about 8.0 mm; preferably the composite heat source has a diameter of between about 4.0 mm to about 5.0 mm. A final diameter of about 4.0 mm allows an annular air space around the composite heat source without causing the diameter of the smoking article to be larger than that of a conventional cigarette.

The rods before baking are called green rods. Because variations in the dimensions of the rods may occur during baking (see discussion, infra), it is preferable to form the green rods at a slightly larger diameter than the final diameter of the heat source.

In order to maximize the transfer of heat from the heat source to flavor bed 21 of the smoking article, one or more air flow passageways 22, as described in Commonly assigned U.S. Pat. No. 5,076,296 may be formed through or along the circumference of the composite heat source. The air flow passageways should have a large geometric surface area to improve the heat transfer to the air flowing through the composite heat source. The shape and number of the passageways should be chosen to maximize the internal geometric surface area of the composite heat source. Alternatively, the composite heat source may be formed with a porosity sufficient to allow heat flow through the composite heat source. When the composite heat source is ignited and air is drawn through the smoking article, the air is heated as it passes around or through the composite heat source or through, over or around the air flow passageways. The heated air flows through a flavor bed, releasing a flavored aerosol for inhalation by the smoker. Preferably, when longitudinal air flow passageways such as those depicted in FIG. 1 are used, maximization of heat transfer to the flavor bed is accomplished by forming each longitudinal air flow passageway 22 in the shape of a multi-pointed star. Even more preferably, as set forth in FIG. 1, each multi-pointed star should have long narrow points and a small inside circumference defined by the innermost edges of the star. These star-shaped longitudinal air flow passageways provide a larger area of the composite heat source that is available for combustion, resulting in a greater volume of the composition being involved in combustion, and therefore a hotter burning composite heat source.

Once the desired shapes have been formed, they are placed in the grooves of graphite sheets which are stacked one over the other in a stainless steel container or on a stainless steel frame. The container or frame containing the stacked graphite sheets is then placed in a heating or baking device such as a muffle furnace or a sagger. Once inside the heating device, the pre-formed shapes are exposed to an environment that will allow for the reduction of the metal oxides and metals to metal species. Preferably, the heating device is pressurized slightly above one atmosphere to prevent diffusion of air.

Figure 3:
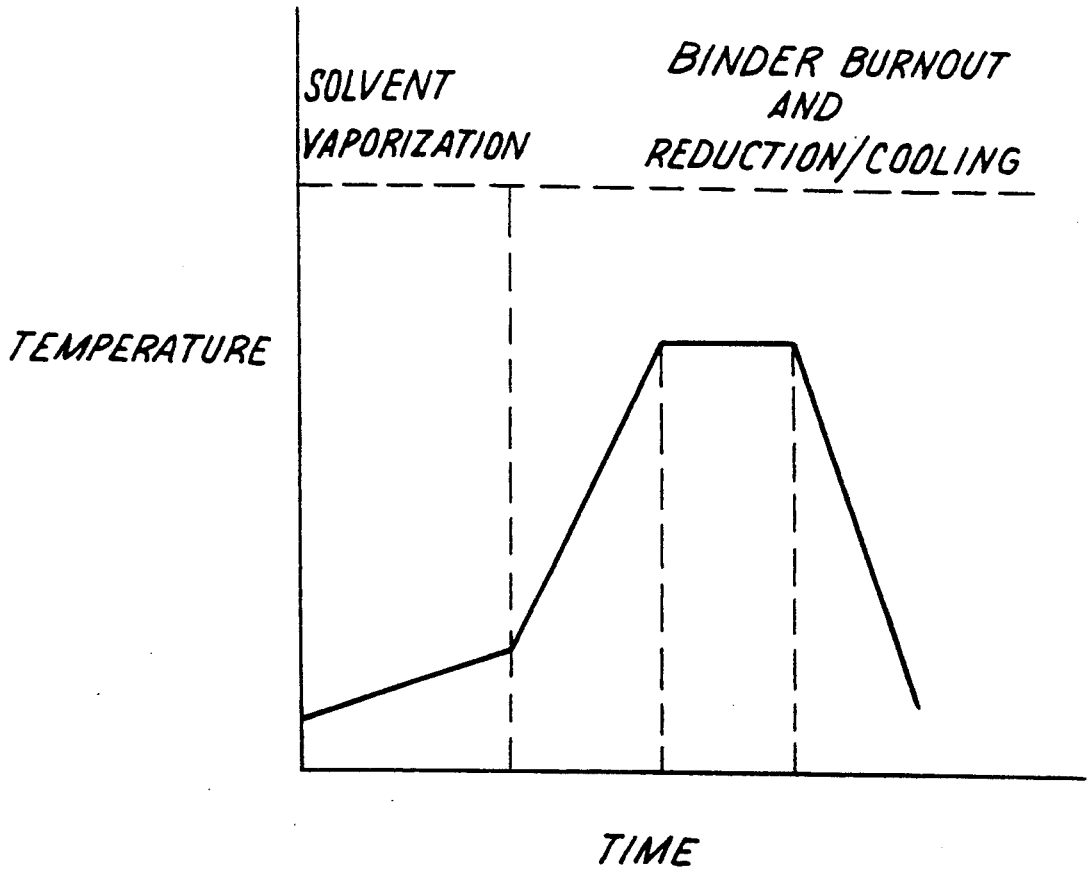
FIG. 3 depicts a heat vs. reaction profile description of the chemical conversion of an iron species to iron carbide.

The chemical reduction may be accomplished by supplying heat to the pre-formed shapes. Heat may be supplied as follows: (1) so that a constant temperature is maintained; (2) in a series of intervals; (3) at an increasing rate, which may be constant or variable; or (4) combinations Additionally, steps such as allowing the pre-formed shapes to cool may be employed. Preferably, however, heat is supplied, as described in FIG. 3, in a multiple-stage baking process involving solvent vaporization followed by binder burnout. Those skilled in the art will understand that thermal processes (such as solvent vaporization and binder burnout) may occur at a wide variety of temperatures, pressures, atmosphere composition, heating time, etc.

Binder burnout involves the vaporization of any solvent present in the pre-formed shape as well as the devolatilization and carbonization of the carbonaceous binder. Furthermore, reduction and carbidization of the metal oxides and metals occurs to form low valency metal oxides or the fully reduced metal or metal carbide. Binder burnout is accomplished by gradually supplying heat to the pre-formed shape under an inert atmosphere, such as helium, nitrogen or argon, or in a vacuum. It is preferable to supply heat to the pre-formed shape initially at a low rate of increase, followed by a greater rate of increase.

The first low rate of temperature increase vaporizes any solvent present in the pre-formed shape without formation of ruptures or cracks. Additionally, a low rate of temperature increase minimizes warping and bending of the pre-formed shape. The initial rate of increase should be between about 0.1° C./min to about 10° C./min, and preferably in the range of about 0.2° C./min to about 5° C./min. This rate of increase is maintained until a temperature in the range of about 100° C. to about 200° C., or, more preferably, a temperature of about 125° C. is reached.

Once the solvent in the pre-formed shape has been vaporized, the rate of heating is increased to further decompose carbonaceous binders in the pre-formed shape and to reduce the metal species. The carbonaceous binder begins to decompose at temperatures in the range of about 200° C. to about 300° C. to a gaseous mixture comprising carbon monoxide and carbon dioxide. Consequently, the rate of heating should be such that the evolution of gaseous products from the pre-formed shape is sufficiently slow to minimize micro-explosions of gaseous products that might adversely affect the structural integrity of the pre-formed shape.

Binder decomposition is a second step in the manufacture of a composite carbon and metal species heat source. (Step 1 involves removal of water in a controlled manner so as to avoid bubbling or blistering or drying cracks associated with the removal of water.)

Since in the preferred embodiment, extruded green rods contain flour, sugar and corn oil along with carbon, metal oxide and metal, thermal decomposition and pyrolysis of flour, sugar and corn oil must be carried out in a controlled manner. Flour, sugar and corn oil have their own distinct decomposition and pyrolysis temperatures along with different yields of carbon after final baking step.

Binders also release various types and amounts of gases at different temperatures, and the rate of gas evolution must be controlled to maintain the integrity of the pre-formed shape. Also, a liquid such as corn oil can become superheated at the baking temperatures if rate of heating is not controlled in a well-defined manner. Metal oxide particles can act as heterogeneous nucleation sites and reduce the energy required for the formation of a nucleus for superheating the liquid. Superheating of liquids with the evolved gases will cause bubbles in the material, and the bubbles will grow if an excess rate of heating is imposed due to the mass vaporization and thermal expension. The bubble growth is also affected by the diffusivity and the viscous resistance of the liquid components. The rate of heating of pre-formed shapes is adjusted by performing a series of experiments to allow mass transfer of gases and liquids from the surface and interior of the heat source. By optimizing the rate of heating of pre-formed shapes during binder decomposition, defects associated with the binder decomposition such as cracks, holes and warping have been eliminated. Quality of the composite heat sources were improved by controlling the above process, and a minimum of 85% yield was obtained with a resulting composite heat source of excellent strength.

Chemical composition of the composite heat source is also an extremely important parameter along with quality and strength. Chemical composition of the composite heat source will determine the lightability of the heat source, rate of heat release during puffing, and ultimately the amount of CO evolved from the heat source. The decomposition of the binders during heating creates a reducing atmosphere inside the sagger, and thus influences the chemical composition of the composite heat source.

Therefore, composition of the evolved gases during baking from flour, sugar and corn oil should be monitored and controlled along with the rate of gaseous evolution from the above components.

The maximum temperature and the length of time the pre-formed shapes remain at the maximum temperature during baking determines the strength of the pre-formed shape. The strength of the pre-formed shape should be sufficient to withstand high speed manufacturing processes, although the strength may be adjusted to match a particular application.

Temperature and time will also determine the extent of binder decomposition and the amount of reducing gases evolved. The reducing gases, in turn, will determine whether $Fe_2O_3$ will be reduced to $Fe_3O_4$, and to FeO and Fe and to iron carbide. The reducing gases determine how much of each phase is present, the lightability of the composite heat source, and the evolved CO when burned. Preferably FeO is a major phase among the resulting reduced metal species.

The baking temperature and the duration of baking also determines the extent of reduction of the metal oxides and metals. For example, the reduction of the metal oxides and metals may be complete once the maximum temperature is reached. If not, the maximum temperature may be maintained until the metal oxides and metals are sufficiently reduced to obtain the desired metal species composition. Alternatively, the temperature may be allowed to slowly decrease while reduction/carbidization of the metal oxides and metals proceeds toward completion.

Preferably, the rate of temperature increase during the binder burnout baking is in the range of about 1° C./min to about 20° C./min. More preferably, the rate of temperature increase is in the range of about 5° C./min. to about 10° C./min. The temperature is increased at this rate until the maximum temperature is reached and the carbonaceous binders are decomposed. Preferably, the maximum temperature is between about 650° C. to about 1100° C., and more preferably in the range of 675° C. to about 1000° C.

For example, at the termination of the binder burnout stage, the preferred product is substantially a mixture of carbon, metal oxide of low valency and a fully reduced metal. A low valency metal oxide is a metal oxide in which the metal is not in the fully oxidized state. Examples of low valency metal oxides include iron oxides such as $Fe_3O_4$ and, more preferably, FeO. When FeO is the low valency metal oxide, it may be stabilized by adjusting the ratio of $CO:CO_2$ present in the heating device.

Reduction of the metal oxides and metals occurs during the heating process by contact with a reducing gas. During heating, the carbonaceous binder decomposes to yield, CO, a reducing gas. Furthermore, when activated carbon is used as the carbon source, it also reacts with the metal oxides and metals to generate CO and a partially reduced metal species. For example, this reducing atmosphere facilitates the reduction of a metal oxide such as iron oxide to one of the following states in a sequential reduction: $Fe_2O_3$ to $Fe_3O_4$, $Fe_3O_4$ to FeO, and FeO to Fe. With each reduction of the metal oxide, the CO is oxidized to $CO_2$.

Rather than rely totally on carbon and the evolved CO to reduce the metal oxides and metals, a reducing agent such as hydrogen gas may also be added to the atmosphere of the heating device. Preferably CO and $CO_2$ are added directly to the heating device atmosphere.

The ratio of CO to $CO_2$ can be manipulated to control the end product distribution of the metal species. The presence of a ratio of CO to $CO_2$ of between about 0.16 and about 6 and more preferably between about 0.3 and about 2.5 has been found to increase the strength of the rod and improve the lightability (the time required to ignite the final heat source) of the final metal species-comprising product. Furthermore, the phase homogeneity of the metal species depends upon the $CO/CO_2$ ratio. The preferred $CO/CO_2$ ratio for a particular application may be found by using the method described by H. L. Fairbanks, *Industrial Heating*, 52, pp. 24–26 (1984).

The nature of the phases, and their amount will depend upon the temperature and duration of baking along with the $CO/CO_2$ ratio inside the sagger. The $CO/CO_2$ ratio can be monitored using an oxygen sensor (also referred to as a carbon sensor) made from a zirconia electrode.

The ratio of $CO/CO_2$ exhibited great influence on the stabilization of low valency metal oxide FeO, known as wustite. Generally, wustite FeO is not stable below 570° C. but is stabilized in the composite heat source by rapid quenching of the composite heat sources after wustite FeO has been formed in the desired quantity. Since presence of wustite FeO was determined to give very low CO values when the heat sources were burned, reducing conditions were optimized by adjusting the $CO/CO_2$ ratio in the range of 0.16 to 6 during binder decomposition and baking. Wustite phase, FeO, and the fully reduced metal phase, Fe, and $Fe_3O_4$ can be adjusted to the desired level with the help of a phase diagram of wustite FeO with temperature and $CO/CO_2$ ratio. Phase diagram of wustite can be found in a book entitled *Non-Stoichiometric Compounds*, edited by C.R.A. Catlow and W. C. Mackrodt published as Volume 23 of the Advances In Ceramics by the American Ceramic Society.

During the formation of low valency oxide phase and metal phase, the reducing gases can also react with the already formed metal to form a metal carbide. The fully reduced oxide, i.e., metal, will react easily with the reducing gases through a series of chemical reactions to form a metal carbide. Therefore, the reducing atmosphere, temperature and time during baking will determine the composition of the resulting metal species. The atmosphere, temperature and time can be adjusted during baking to preferentially form a low valency metal oxide (e.g., FeO); a fully reduced metal (e.g, Fe); and a metal carbide (e.g., iron carbide).

Most iron carbides formed under these conditions at temperatures above 500° C., and in the range 500° C. to 1000° C. are of $Fe_3C$ phases, and have high ignition temperatures. The requirement of lower ignition temperature necessitated a combination of carbide and Fe phases; or a combination of carbide, Fe and FeO phases or a combination of Fe and FeO phases; or a combination of Fe, FeO, and $Fe_3O_4$ phases.

Since the objective of the composite carbon and metal species heat source is to also have a low evolved CO when the heat source is burned, it would be desirable to have FeO phases. Experimental observations indicate that the composite heat sources containing Fe and FeO resulted in lower CO values with good strength and lower ignition temperatures. Although similar results were obtained with the composite heat sources containing a metal carbide phase along with a phase such as Fe and FeO or Fe alone, the additional baking time does not provide any significant advantages. Also the additional baking time will add to the manufacturing cost of the composite heat source, albeit, in a small fraction.

The metal species produced by the above method may contain localized pyrophoric sites having increased reactivity, which must be passivated. Passivation involves the controlled exposure of the composite heat source to an oxidant. Preferred oxidants include dilute oxygen or, more preferably, dilute air. While not wishing to be bound by theory, it is believed that a low concentration of oxidant will eliminate pyrophoric sites while preventing the uncontrolled combustion of the composite heat source.

As stated above, variations in the dimensions of the pre-formed shape rod will occur during baking. Generally, between about 10% to about 20% change in volume will occur as a result of the binder burnout. This change in volume may cause warping or bending. The pre-formed shape may also suffer inconsistencies in diameter. Following baking, therefore, the pre-formed shape may be tooled or ground to the dimensions described above. In the preferred embodiment, the elongated rod is then cut into segments of between about 8 mm to about 20 mm, preferably between about 10 mm to about 14 mm.

The metal species component of the composite heat source is of sufficiently low ignition temperature, to permit ignition under the conditions for lighting a conventional cigarette (i.e., a match). The carbon component, upon combustion, provides additional heat so that the heat source does not prematurely self-extinguish. The low valency metal oxide component acts as a catalyst, promoting the oxidation of CO to $CO_2$.

The ignition temperature of the composite heat source is preferably in the range of between about 175°

C. and about 450° C., and, more preferably between about 190° C. and about 400° C. Upon ignition, the composite heat source reaches a maximum temperature preferably between about 500° C. and about 950° C. and, more preferably, between about 650° C. and about 850° C. The maximum temperature will depend in part upon the smoking conditions and any materials in contact with the composite heat source which affect the availability of oxygen. Thus, composite heat sources made by the methods of this invention are substantially easier to light than conventional carbonaceous heat sources and less likely to self-extinguish, but at the same time can be made to smolder at lower temperatures, thereby minimizing the risk of fire.

The composite heat sources made by the method of this invention also have a very low amount of total CO evolution during combustion as compared to conventional carbonaceous heat sources.

The composite heat sources made by the method of this invention are stable under a broad range of relative humidity conditions and aging times. For example, aging of the composite heat source up to three months under a variety of relative humidity conditions ranging from 0% relative humidity to 100% relative humidity have virtually no effect on the combustion products. Furthermore, the heat sources undergo virtually no change in dimensions upon aging.

EXAMPLE 1

We combined 710 g $Fe_2O_3$, 250 g activated carbon, 260 g water, and 37.5 g potassium citrate with a binder made from 200 g flour, 103 g sugar and 22 g corn oil. The $Fe_2O_3$/activated carbon/binder mixture was then extruded to form green rods 30 cm in length and 5.05 mm in diameter with a single star-shaped air flow passageway. We placed the green rods on grooved graphite sheets and stacked them in a fixed-bed reactor at room temperature. Argon with a flow rate of 1 liter/min was used as a carrier gas to purge the gaseous content of reactor. The rods were heated at a rate of 1° C./min until a temperature of 100° C. was reached. The temperature was then increased at a rate of 5° C./min until a temperature of 925° C. was reached. The reactor was then cooled down over a period of 7 hours until a temperature of 350° C. was reached. We maintained the temperature at 350° C. for 3 hours and then cooled the reactor to ambient temperature and slowly exposed it to air. The carbon and metal species rod was then cut with a saw into segments of 14 mm to form the composite heat sources.

X-ray analysis of the product indicated that the major metal species phase was Fe and the minor metal species phase was iron carbide. Chemical analysis of the product indicated that the heat source contained about 21.12% of carbon, 57.94% of iron, 9.71% of oxygen, and 1.03% of potassium. The balance included various other elements present in minor quantities.

The composite heat source made by the above method gave a specific surface area of 209 $m^2/g$, a crush strength of 14 pounds. When the composite heat source produced by this method was heated in argon and 21% oxygen mixture to a maximum temperature of 1000° C. and analyzed the gases using a mass spectrometer, the total evolved carbon monoxide was found to be 17 μg/mg.

When a smoking article was constructed with the above heat source and ignited, the heat source burned for a total of nine puffs with an aerosol delivery of 4.03 mg, CO of 0.8 mg, and CO, of 23.38 mg.

EXAMPLE 2

In this example, the amount of iron oxide was reduced to 316 g (as opposed to 710 g in EXAMPLE 1), and all other components were kept constant. An identical baking procedure as in EXAMPLE 1 was used.

X-ray analysis of the product indicated that the major phase was still metallic iron and the minor phase was metal carbide, although, in a smaller quantity. Chemical analysis of the product indicated that the composite heat source contained 44.65% of iron, 35.22% of carbon, 9.34% of oxygen, and 1.20% of potassium. The balance included various elements present in minor quantities.

The composite heat source made by the above method gave a specific surface area of 201 $m^2/g$, a crush strength of 26 pounds with a total evolved CO of 26 μg/mg when analyzed by mass spectrometer after heating the composite heat source in a mixture of argon with 21% oxygen.

When a smoking article was constructed with the above composite heat source and ignited, the composite heat source burned for a total of 10 puffs with an aerosol delivery of 4.65 mg, CO of 1.70 mg, and $CO_2$ of 28.17 mg.

It should be noted that the initial activated carbon to $Fe_2O_3$ was doubled in this example as compared to EXAMPLE 1.

EXAMPLE 3

We combined 710 g $Fe_2O_3$, 250 g activated carbon, 275 g water, and 37.5 g potassium citrate made with a binder mix consisting of 200 g flour, 103 g sugar, and 22 g corn oil. The $Fe_2O_3$/activated carbon/binder mixture was then extruded to form green rods of 30 cm length with a single star-shaped passageway. We placed the green rods on grooved graphite sheets and stacked them in a fixed bed reactor at room temperature. Argon/CO/$CO_2$ gases in the ratio of 4.0/0.7/0.5 liters/min were used as carrier gases during baking of the green rods. The evolved gases from the binders and the CO/$CO_2$ mixture resulted in simulating the desired reducing atmosphere during binder decomposition and baking step. The rods were baked at a rate of 1° C./min until a temperature of 100° C. was reached. The temperature was then increased at a rate of 5° C./min until a temperature of 740° C. was reached. The fixed bed reactor was heated for 30 min at 740° C., and was then cooled to a temperature of 490° C., and kept at that temperature for a duration of 120 min. After that, the reactor was cooled to ambient temperature and then slowly exposed to air. The carbon and metal species comprising rod was then cut with a saw into segments of 14 mm, and were ground to 4 mm outer diameter.

X-ray analysis of the product indicated that the major iron species was FeO, with a smaller amount of metallic Fe. The crush strength of the composite heat source was 34 pounds.

When a smoking article was constructed with the above composite heat source and ignited, the composite heat source burned for a total of seven puffs with a total evolved CO of 0.1 mg, and a total evolved $CO_2$ of 13.1 mg.

Thus, it is seen that this invention provides a heat source comprising substantially metal carbides, with smaller amounts of carbon and metal oxides that produces virtually no carbon monoxide gas upon combustion and has a significantly lower ignition temperature than conventional carbonaceous heat sources, while at the same time maximizes heat transfer to the flavor bed.

One skilled in the art will appreciate that the present invention can be practiced by other than the described embodiments, which are presented herein for the purpose of illustration and not of limitation, and that the present invention is limited only by the claims which follow.

We claim:

1. A combustion heat source for use in a smoking article comprising low valency metal oxide, metal and metal carbide, wherein the low velency metal oxide includes wustite FeO in a quantity sufficient so that substantially all carbon monoxide produced during combustion of the heat source is converted to carbon dioxide.

2. A combustion heat source for use in a smoking article comprising metal carbide, metal, low valency metal oxide and carbon, wherein the low valency metal oxide includes wustite FeO in a quantity sufficient so that substantially all carbon monoxide produced during combustion of the heat source is converted to carbon dioxide.

3. The heat source of claim 1 or 2, wherein the heat source is substantially in the form of a cylindrical rod and has one or more fluid passages therethrough.

4. The heat source of claim 3, wherein the cylindrical rod has a diameter of between about 3.0 mm and about 8.0 mm.

5. The heat source of claim 3, wherein the cylindrical rod has a diameter of between about 4.0 mm and 5.0 mm, and a length of between about 10 mm and about 14 mm.

6. The heat source of claim 3, wherein the fluid passages are formed in the shape of a multi-pointed star.

7. The heat source of claim 3, wherein the fluid passages are formed as grooves around the circumference or in the interior of the cylindrical rod.

8. The heat source of claim 1 or 2, wherein the metal carbide is iron carbide.

9. The heat source of claim 1 or 2, wherein the metal carbide is of $Fe_3C$ phase.

10. The heat source of claim 1 or 2, wherein the heat source has a surface area of between about 0.25 $m^2/g$ and about 250 $m^2/g$.

11. The heat source of claim 1 or 2, wherein the heat source has an ignition temperature of between about 175° C. and about 450° C.

12. The heat source of claim 1 or 2, wherein the heat source has an ignition temperature of between about 190° C. and about 400° C.

13. The heat source of claim 1 or 2, wherein the heat source has a combustion temperature of between about 500° C. and about 950° C.

14. The heat source of claim 1 or 2, wherein the heat source has a combustion temperature between about 650° C. and about 900° C.

15. A smoking article comprising a combustion heat source, wherein the combustion heat source comprises metal, metal carbide, and wustite FeO in a quantity sufficient so that substantially all carbon monoxide produced during combustion of the heat source is converted to carbon dioxide.

16. The smoking article of claim 15, wherein the combustion heat source further comprises carbon.

* * * * *